US006636154B2

(12) United States Patent
Brundage et al.

(10) Patent No.: US 6,636,154 B2
(45) Date of Patent: Oct. 21, 2003

(54) AIR CONDITION SENSOR HOUSING WITH INTEGRAL LABYRINTH

(76) Inventors: Thomas B. Brundage, P.O. Box 418, Ottawa, KS (US) 66067; Brian C. Hall, P.O. Box 418, Ottawa, KS (US) 66067

( * ) Notice: Subject to any disclaimer, the term of this patent is extended or adjusted under 35 U.S.C. 154(b) by 0 days.

(21) Appl. No.: 09/981,023

(22) Filed: Oct. 17, 2001

(65) Prior Publication Data

US 2003/0071740 A1 Apr. 17, 2003

(51) Int. Cl.[7] ..... G08B 23/00

(52) U.S. Cl. ..... 340/693.6; 340/693.5; 340/693.9; 340/628; 250/574

(58) Field of Search ..... 340/693.6, 693.5, 340/693.9, 693.11, 628, 629, 630; 250/573, 574

(56) References Cited

U.S. PATENT DOCUMENTS

| | | | | | |
|---|---|---|---|---|---|
| 4,758,733 | A | | 7/1988 | Mochizuki | |
| 4,851,819 | A | * | 7/1989 | Kawai et al. | 340/630 |
| 4,897,634 | A | * | 1/1990 | Sawa et al. | 340/630 |
| 5,280,273 | A | * | 1/1994 | Goldstein | 340/632 |
| 5,400,014 | A | * | 3/1995 | Behlke et al. | 340/630 |
| 5,430,307 | A | * | 7/1995 | Nagashima | 250/574 |
| 5,589,824 | A | * | 12/1996 | Lynch | 340/628 |
| 5,642,099 | A | * | 6/1997 | Nagashima | 340/630 |
| 5,751,218 | A | | 5/1998 | Winterble et al. | |
| 5,821,866 | A | * | 10/1998 | Bernal et al. | 340/630 |
| 5,936,533 | A | * | 8/1999 | Bernal et al. | 340/630 |
| D439,538 | S | * | 3/2001 | Lynch | D10/106 |

* cited by examiner

*Primary Examiner*—Toan Ngoc Pham
(74) *Attorney, Agent, or Firm*—Dale J. Ream

(57) ABSTRACT

An ambient air condition sensor housing includes a front portion releasably coupled to a rear portion and defining an interior space therebetween adapted to retain at least one ambient air condition sensor. The rear portion defines apertures for passage of the ambient air therethrough. A labyrinth having a plurality of spaced apart upstanding walls is integrally attached to an inner surface of the rear portion and is positioned so as to cooperate with the air condition sensor. Each wall of the labyrinth includes a slightly arcuate configuration for funneling the ambient air toward the air condition sensor. The rear portion and labyrinth are completely covered with a black coating so as to minimize light reflectivity within the interior space whereby to enhance proper functioning of the air sensor.

5 Claims, 3 Drawing Sheets

AIR CONDITION SENSOR HOUSING WITH INTEGRAL LABYRINTH

BACKGROUND OF THE INVENTION

This invention relates generally to ambient air condition housings and, more particularly, to an air condition sensor housing having an integral labyrinth for efficiently receiving an ambient air stream and for effectively minimizing reflection of light within the housing and labyrinth.

Air condition detection systems typically include a labyrinth component for receiving and directing ambient air into contact with an air condition sensor, such as a smoke, carbon monoxide, or heat sensor. One disadvantage of existing housings with labyrinth components is that the labyrinth is a separate component connected to a circuit board or air sensor. This configuration yields manufacturing and assembly inefficiencies, increased breakage potential, and lack of maximum air flow efficiency. In addition, individual labyrinth components may include a black or non-reflective coating or construction for reducing internal light reflection although the outer housing does not include a similar construction. This leads to stray light reflection within the housing which may cause incorrect sensor readings and false alarm conditions.

Therefore, it is desirable to have an ambient air condition sensor housing with a labyrinth integrally connected to an inner housing surface. Further, it is desirable to have an air condition housing in which both a housing portion and the labyrinth are constructed of the same black or non-reflective material so as to minimize undesirable light reflection. In addition, it is desirable to have an air condition housing and labyrinth having a cooperative construction which maximizes air flow efficiency for accelerated analysis of fire event conditions.

SUMMARY OF THE INVENTION

An air sensor housing with an integral labyrinth according to the present invention includes a front portion releasably connected to a rear portion, the front and rear portions defining an interior space suitable for retaining one or more air sensors and related air condition sensing components. The rear portion of the housing includes perforations or other openings for receiving ambient air into the interior space of the housing. A labyrinth is integrally constructed as part of the rear portion and includes a plurality of walls extending upwardly from an inner surface of the rear portion. The plurality of walls are spaced apart and arranged radially about an imaginary axis for receiving ambient air entering the housing through the perforations. The labyrinth and rear portion are constructed of the same material, said material having a flat black appearance or being coated with a dark non-reflective coating such that light reflecting about the interior space of the housing is minimized.

Therefore, a general object of this invention is to provide an air condition sensor housing having a rear portion with a labyrinth integrally connected thereto.

Another object of this invention is to provide a housing, as aforesaid, in which the integral housing and labyrinth are constructed of a non-reflective material.

Still another object of this invention is to provide a housing, as aforesaid, in which the rear portion and labyrinth are configured to cooperate for accelerated ambient air flow therethrough.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
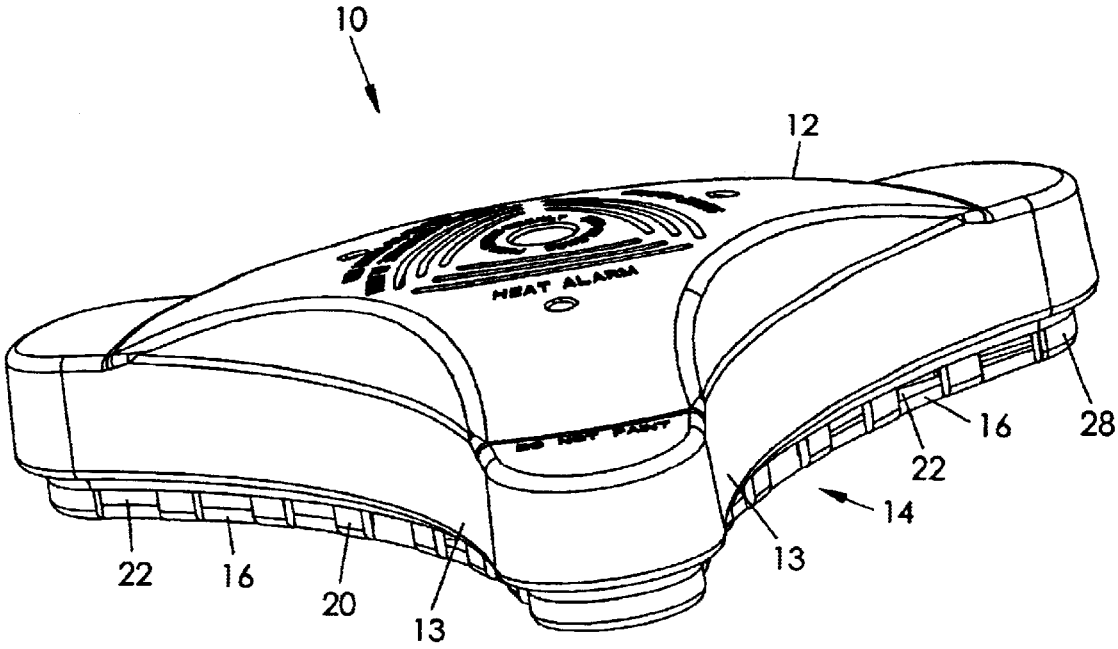
FIG. 1 is a perspective view of an ambient air condition housing according to a preferred embodiment of the present invention.
Figure 2:
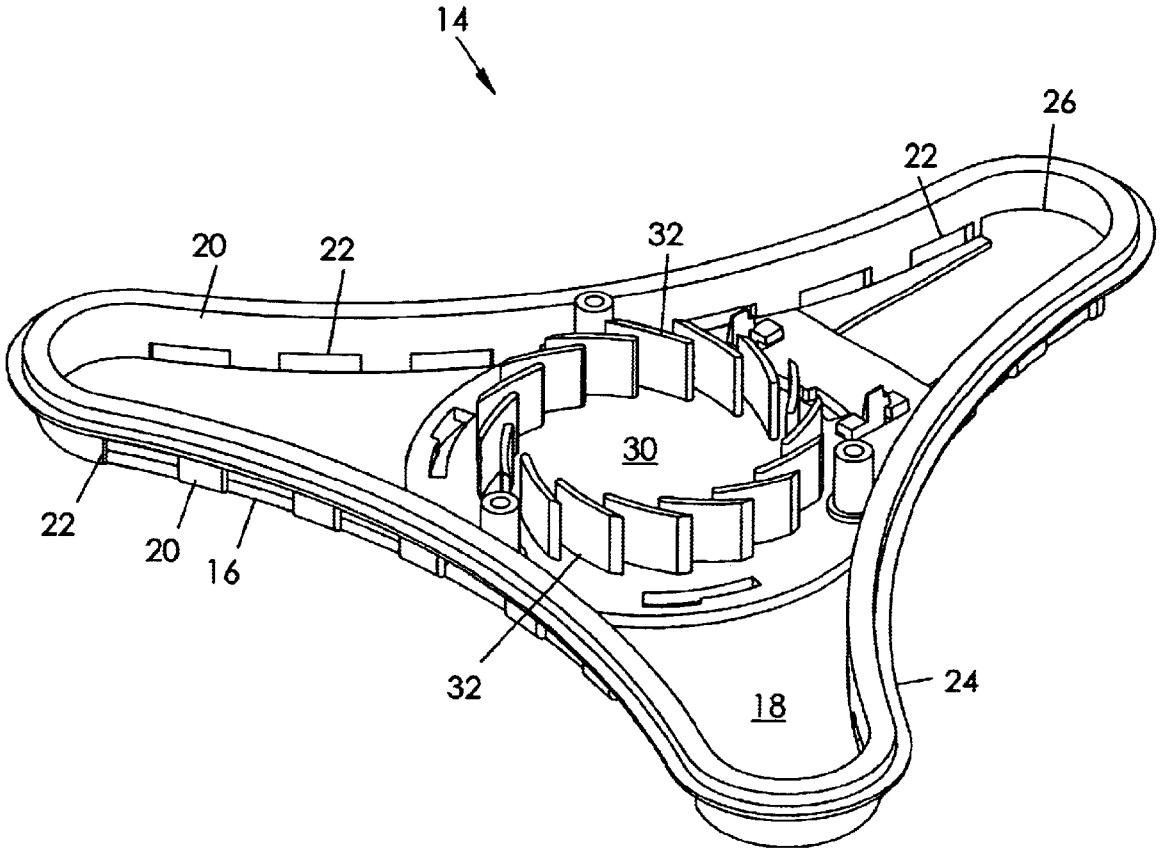
FIG. 2 is a perspective view of the interior of a rear portion of the housing as in FIG. 1.
Figure 3:
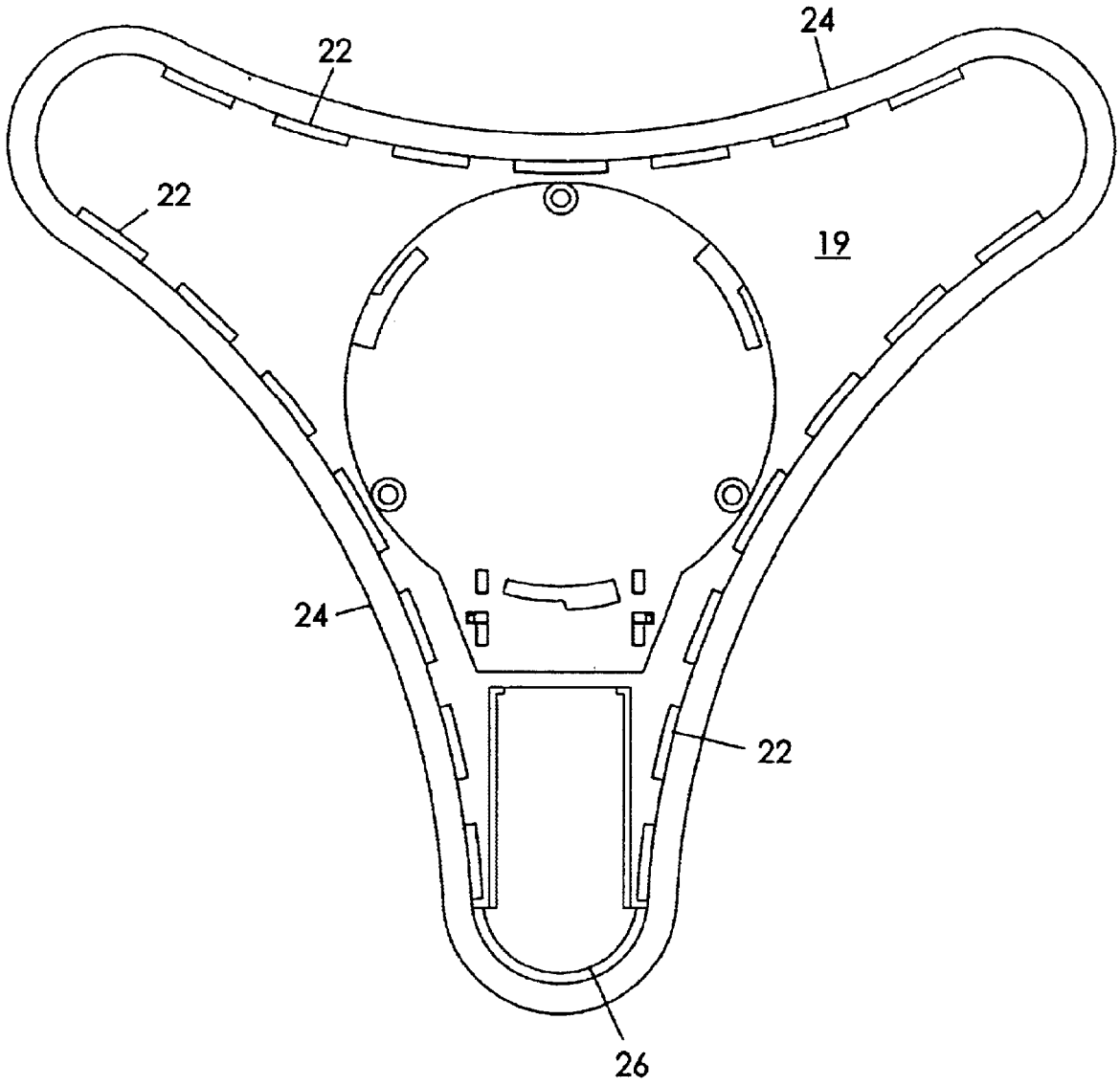
FIG. 3 is a back view of the rear portion of the housing as in FIG. 2.

An air condition sensor housing 10 with an integral labyrinth will now be described in detail with reference to FIGS. 1 through 3 of the accompanying drawings. The housing 10 includes a front portion 12 releasably attached to a rear portion 14 and defining an interior space suitable to retain at least one air condition sensor and related components such as an alarm circuit (not shown). It is understood that the front 12 and rear 14 portions may be releasably connected in a snap-fit relationship or coupled together with screws or similar fasteners (FIG. 3). The front portion includes a side wall 13 having multiple segments with concave configurations for collecting volumes of ambient air (FIG. 1). The rear portion 14 includes a base 16 having inner 18 and outer 19 surfaces and an upstanding side wall 20 extending normal and inwardly along a peripheral edge of the base 16 (FIG. 2). The side wall 20 defines a plurality of apertures 22 spaced apart therealong. It should be appreciated, however, that the rear portion 14 may include perforations or other configurations for receiving ambient air into the interior space of the housing 10. The free edge of the side wall 20 includes a ledge configuration 24 complementary to a corresponding edge of the front portion 12 for proper alignment and frictional engagement of the front 12 and rear 14 portions (FIG. 2). The rear portion 14 may also include an opening 26 (FIG. 2) for insertion or removal of a battery and includes a battery door 28 (FIG. 3).

A labyrinth 30 is integrally formed as part of the base 16 of the rear portion 14 and includes a plurality of spaced apart walls 32 extending upwardly from the inner surface thereof (FIG. 2). Each wall 32 is perpendicular to the inner surface 18 of the base 16 and includes a slightly arcuate configuration for aerodynamically funneling ambient air into contact with at least one air condition sensor (not shown). The labyrinth walls 32 are arranged in a radial configuration about an imaginary central axis. It is understood that ambient air sensors would be retained within the circle of labyrinth walls 32. It should also be appreciated that the rear portion 14 includes a circumference greater than a circumference of the labyrinth (FIG. 2).

The rear portion 14 of the housing 10 and the labyrinth 30 are constructed of a rigid plastic material although a metal construction such as aluminum would also be suitable. Both the rear portion 14 and the labyrinth 30 are constructed of a material having a flat black texture although they may be merely coated or painted with a non-reflective layer at the time of manufacture. Undesired light leaks or stray light reflections within the interior space of the housing 10 result in improper sensor function which lead to false alarms if both the rear portion 14 of the housing 10 and the labyrinth 30 are not constructed or coated with a flat black or otherwise non-reflective material.

Preferably, the front 12 and rear 14 portions present complementary generally triangular configurations wherein the side wall 20 includes respective concave portions adapted to accelerate the ambient air into side wall apertures 22 and on to the labyrinth 30 for accelerated analysis of air conditions (FIGS. 1 and 2). It should be appreciated that it is a volume of ambient air accumulated by a convex segment of the front portion side wall 13 that is received into said wall apertures 22. It is understood, however, that any other configuration, such as rectangular or circular configurations, would also be suitable for the housing 10.

In function, the integral rear portion 14 with a labyrinth 30 is easy and economical to manufacture and reduces assembly inefficiencies. The non-reflective construction of the rear portion 14 and labyrinth greatly reduce the potential for light leakage or reflections within the interior space of the housing 10 as a whole. Accordingly, the present invention reduces the potential for incorrect sensor readings and, thus, false alarms.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An air condition detector housing adapted to contain a sensor of ambient air and an alarm circuit, said housing comprising:

a front portion including a front portion side wall extending peripherally thereabout, said front portion side wall having at least one segment having a concave configuration for collecting a volume of air;

a rear portion releasably coupled to said front portion and defining an interior space therebetween for retaining the air sensor and alarm circuit, said rear portion having an inner surface;

a labyrinth integrally connected to said inner surface of said rear portion and adapted to communicate said volume of air to the air sensor;

said rear portion including a continuously extending peripheral side wall defining a plurality of spaced apart slots, at least a portion of said side wall having a concave configuration for aerodynamically funneling and accelerating said volume of air through said slots;

wherein said rear portion includes a circumference greater than a circumference of said labyrinth;

wherein said rear portion and said labyrinth include a black coating such tat said rear portion and said labyrinth inhibit the reflection of light within said interior space;

wherein said labyrinth includes a plurality of spaced apart upstanding walls extending radially about an imaginary axis, each wall having a slightly arcuate configuration for funneling the ambient air toward the air sensor; and wherein said front and rear portions include a generally triangular configuration.

2. The housing as in claim 1 wherein said labyrinth includes a plurality of spaced apart upstanding walls extending radially about an imaginary axis, each wall having a slightly arcuate configuration for funneling the ambient air toward the air sensor.

3. The housing as in claim 1 wherein said front and rear portions include a generally rectangular configuration.

4. The housing as in claim 1 wherein said front and rear portions include a generally circular configuration.

5. The housing as in claim 1 wherein said front and rear portions include a generally triangular configuration.

* * * * *